US005129791A

United States Patent [19]

Nakajima

[11] Patent Number: 5,129,791

[45] Date of Patent: Jul. 14, 1992

[54] VARIABLE CAPACITY VANE COMPRESSOR CONTROLLABLE BY AN EXTERNAL CONTROL SIGNAL

[75] Inventor: Nobuyuki Nakajima, Konan, Japan

[73] Assignee: Zexel Corporation, Tokyo, Japan

[21] Appl. No.: 675,655

[22] Filed: Mar. 27, 1991

[30] Foreign Application Priority Data

Apr. 6, 1990 [JP] Japan ..... 2-091443

[51] Int. Cl.[5] ..... F04B 49/00; F04B 1/26

[52] U.S. Cl. ..... 417/295; 417/310; 417/222 S

[58] Field of Search ..... 417/295, 310, 222 S

[56] References Cited

U.S. PATENT DOCUMENTS

| | | | |
|---|---|---|---|
| 4,752,189 | 6/1988 | Bearint et al. | 417/222 S |
| 4,892,466 | 1/1990 | Taguchi et al. | 417/295 |
| 5,017,096 | 5/1991 | Sugiura et al. | 417/295 |
| 5,056,990 | 10/1991 | Nakajima | 417/295 |

FOREIGN PATENT DOCUMENTS 63-85285 4/1988 Japan .

63-205478 8/1988 Japan .

*Primary Examiner*—Richard A. Bertsch
*Assistant Examiner*—Alfred Basichas
*Attorney, Agent, or Firm*—Frishauf, Holtz, Goodman & Woodward

[57] ABSTRACT

A variable capacity vane compressor has a control element for determining timing of start of compression of a refrigerant gas. In a high-pressure chamber there prevails control pressure which acts on the control element for urging same toward a maximum capacity position thereof. The control pressure is created by introducing the refrigerant gas from a discharging space within which discharge pressure prevails into the high-pressure chamber via a high pressure-introducing passageway. The high pressure-introducing passageway has a restriction hole for restricting flow of the refrigerant gas. An electromagnetic value opens and closes the restriction hole in response to an external control signal. The refrigerant gas is allowed to constantly leak from the high-pressure chamber into a suction chamber via a leak passage, the leak passage having a cross-sectional area smaller than that of the restriction hole.

7 Claims, 5 Drawing Sheets

VARIABLE CAPACITY VANE COMPRESSOR CONTROLLABLE BY AN EXTERNAL CONTROL SIGNAL

BACKGROUND OF THE INVENTION

This invention relates to a variable capacity vane compressor for compressing refrigerant gas circulating in an air conditioner installed on an automotive vehicle, or for like applications, and more particularly to a vane compressor of this kind the capacity of which can be controlled by an external control signal.

Conventionally, variable capacity vane compressors of this kind controllable by external control signals have been proposed, e.g. by Japanese Provisional Patent Publications (Kokai) Nos. 63-205478 and 63-85285, each of which comprises a control element disposed to rotate between the minimum capacity position and the maximum capacity position for controlling the timing of start of compression, a low-pressure chamber which is formed on one side of a pressure-receiving protuberance of the control element and into which is introduced suction pressure as low pressure, a high-pressure chamber formed on the other side of the pressure-receiving protuberance and into which is introduced discharge pressure as high pressure via a restriction passage to create control pressure therein, the control element being rotated in response to difference between the sum of the suction pressure introduced into the low-pressure chamber and the urging force of urging means, and the control pressure, and an electromagnetic valve for opening and closing a passageway which communicates between the high-pressure chamber and a suction chamber, wherein the opening and closing of the passageway by the electromagnetic valve is controlled by an external control signal supplied from the outside of the compressor to control the flow rate of refrigerant gas leaking from the high-pressure chamber into the suction chamber to vary the control pressure within the high-pressure chamber such that the control element is rotated in accordance with variation in the control pressure, to thereby control the capacity of the compressor in a continuous manner.

According to these prior art vane compressors, the passageway communicating between the high-pressure chamber and the suction chamber is opened and closed by the electromagnetic valve to vary the control pressure within a range of approx. 2 to 14 kg/cm$^2$ so that the capacity of the compressor is continuously changed between the minimum and maximum values. Further the cross-sectional area of the passageway is large. More specifically, when the capacity of the compressor is the maximum, refrigerant gas under pressure as high as approx. 14 kg/cm$^2$ acts on the electromagnetic valve, and moreover, the flow rate of refrigerant gas under such high pressure leaking from the high-pressure chamber into the suction chamber is controlled by opening and closing the passageway which has such a large cross-sectional area with the electromagnetic valve, which gives a heavy burden to the electromagnetic valve. Therefore, the electromagnetic valve has to be designed to have a strong valve-closing force (magnetically attractive force), which, however, results in an increased size of the electromagnetic valve.

Further, according to the prior art vane compressors, in order to control the capacity of the compressor in a fine manner by an external control signal from the outside, a large electromagnetic valve is required, which is excellent in responsiveness and capable of controlling a large amount of refrigerant gas.

SUMMARY OF THE INVENTION

It is the object of the invention to provide a variable capacity vane compressor the capacity of which can be controlled by an external control signal in a fine manner by the use of an electromagnetic valve which is excellent in responsiveness and has a small valve-closing force.

To attain the above object, the present invention provides a variable capacity vane compressor being controllable by an external control signal, including a suction chamber, a discharging space within which discharge pressure prevails, a control element for determining timing of start of compression of a refrigerant gas, the control element having a pressure-receiving portion, a low-pressure chamber within which prevails suction pressure acting on the pressure-receiving portion of the control element, urging means cooperating with the suction pressure for urging the control element toward a minimum capacity position thereof, a high-pressure chamber within which prevails control pressure acting on the pressure-receiving portion of the control element for urging the control element toward a maximum capacity position thereof, and high pressure-introducing passage means for introducing the refrigerant gas from the discharging space into the high-pressure chamber to create the control pressure therein, the high pressureintroducing passage means having a restriction hole for restricting flow of the refrigerant gas.

The variable capacity vane compressor according to the invention is characterized by comprising:

an electromagnetic valve diposed to open and close the restriction hole in response to the external control signal; and leak passage means for allowing the refrigerant gas to constantly leak from the high-pressure chamber into the suction chamber, the leak passage means having a cross-sectional area smaller than that of the restriction hole.

Preferably, the opening and closing of the restriction hole by the electromagnetic valve is controlled by varying a duty ratio of the external control signal.

The above and other objects, features, and advantages of the invention will become more apparent from the ensuing detailed description taken in conjunction with the accompanying drawings.

BRIEF DESCIPTION OF THE DRAWINGS

Figure 1:
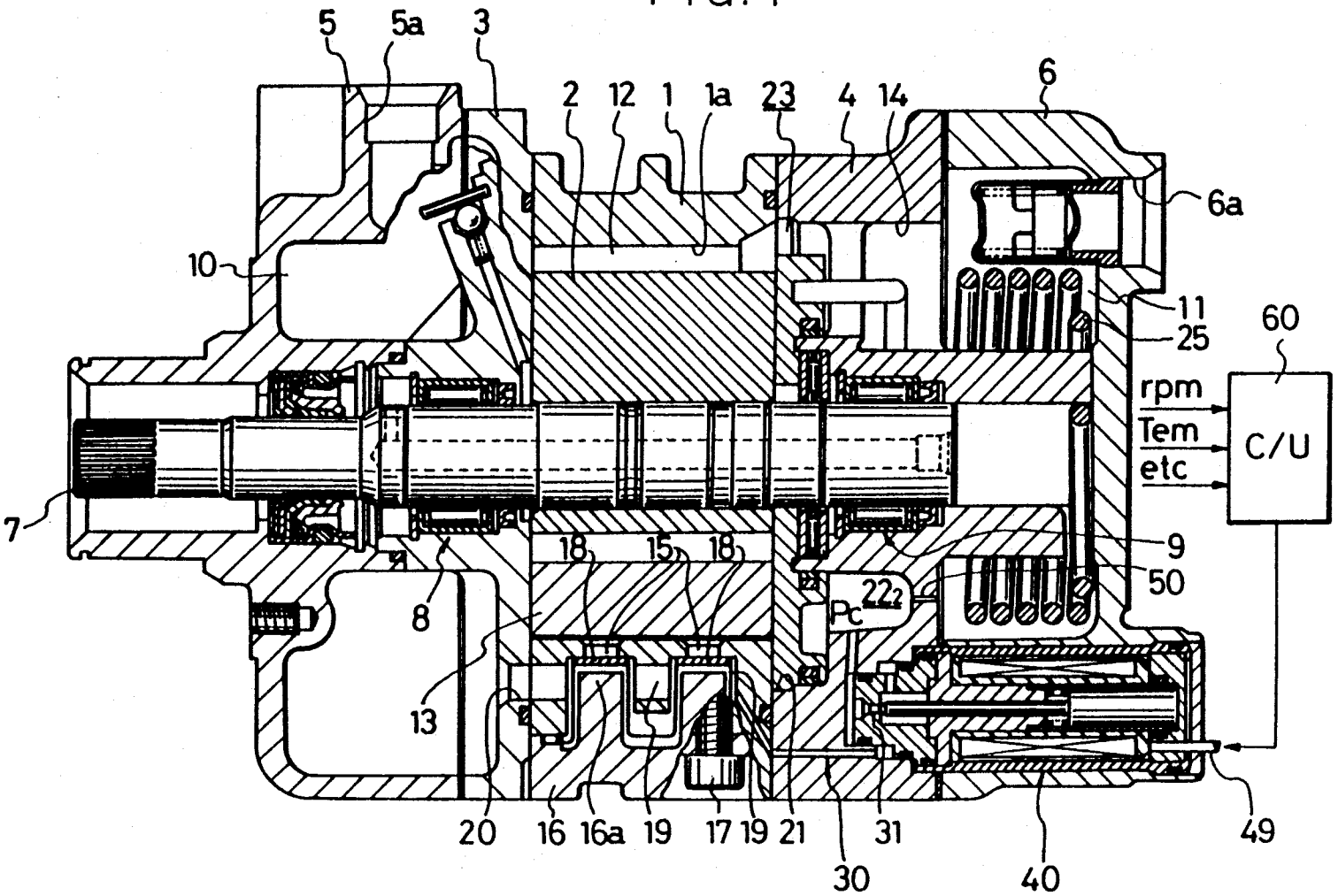
FIG. 1 is a cross-sectional view of a variable capacity vane compressor which can be controlled by an external control signal, according to an embodiment of the invention.
Figure 2:
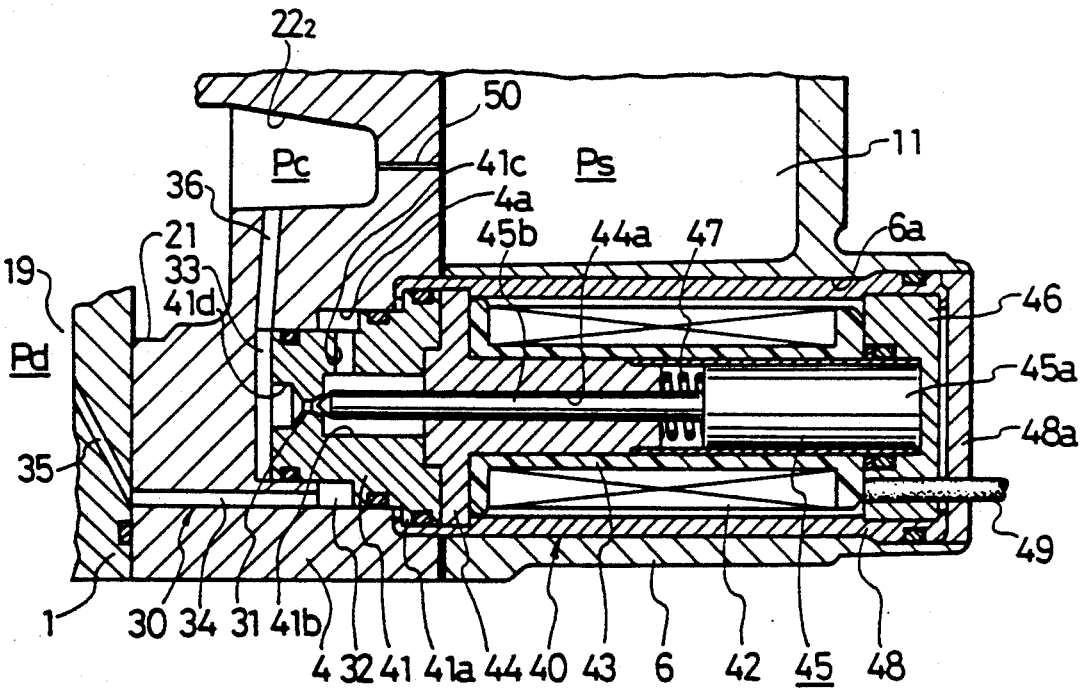
FIG. 2 is a cross-sectional view, on an enlarged scale, of essential parts of the embodiment of FIG. 1.
Figure 3A:
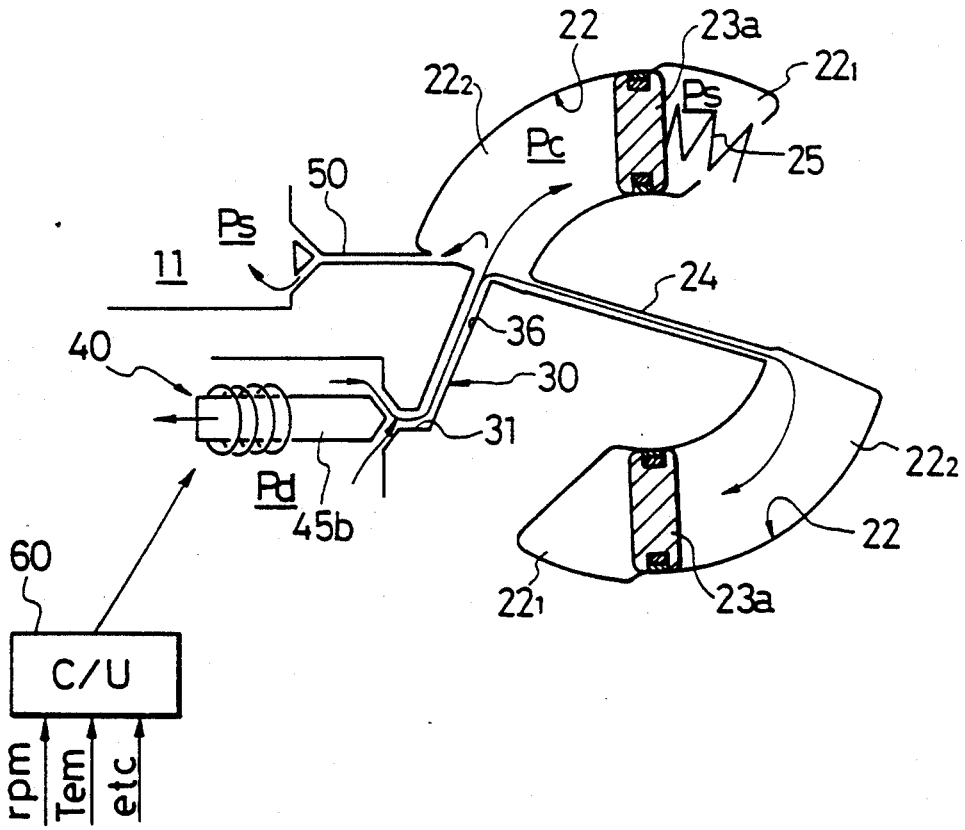
Figure 3B:
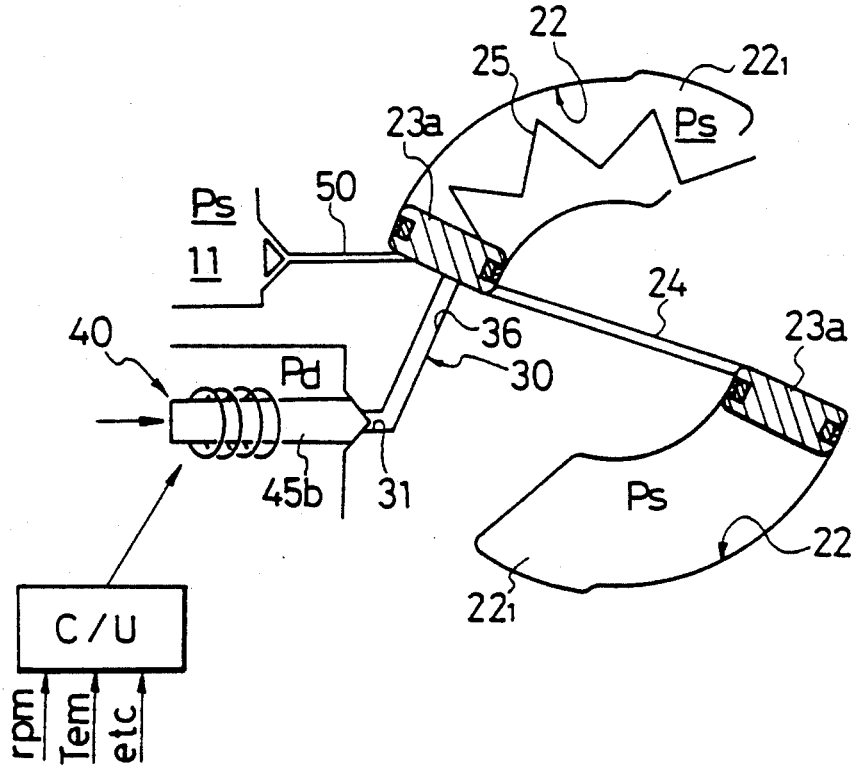
Figure 4:
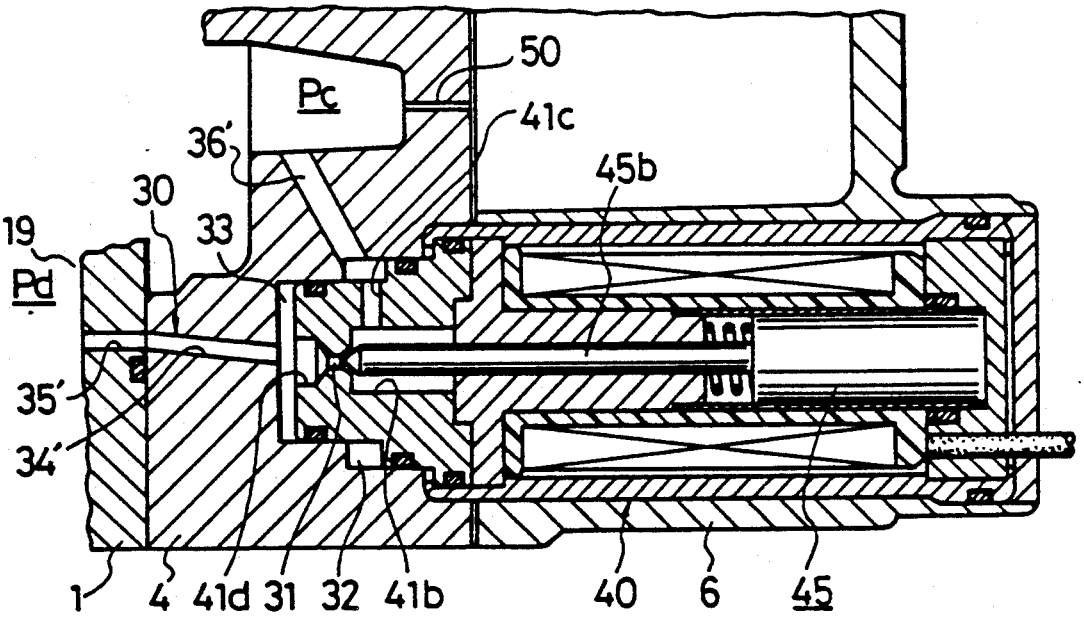

FIG. 3*a* is a view useful in explaining the state of the compressor in which an electromagnetic valve in FIG. 1 is open;

FIG. 3*b* is a view useful in explaining the state of the compressor in which the electromagnetic valve is closed; and FIG. 4 is a view similar to FIG. 2, showing a variation of the invention.

DETAILED DESCRIPTION

The invention will now be described in detail with reference to the drawings, showing an embodiment thereof.

Referring to FIG. 1, the variable capacity vane compressor which can be controlled by an external control signal supplied from the outside is composed mainly of a cylinder formed by a cam ring 1 having an inner peripheral surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 secured to outer ends of the respective front and rear side blocks 3 and 4, and a driving shaft 7 on which is secured the rotor 2. The driving shaft 7 is rotatably supported by a pair of radial bearings 8 and 9 provided in the respective side blocks 3 and 4.

A discharge port 5*a* is formed in an upper wall of the front head 5, through which a refrigerant gas is to be discharged as a thermal medium, while a suction port 6*a* is formed in an upper rear end wall of the rear head 6, through which the refrigerant gas is to be drawn into the compressor. The discharge port 5*a* and the suction port 6*a* communicate, respectively, with a discharge pressure chamber 10 defined by the front head 5 and the front side block 3, and a suction chamber 11 defined by the rear head 6 and the rear side block 4.

A pair of compression spaces 12, 12 are defined at diametrically opposite locations between the inner peripheral surface 1*a* of the cam ring 1, the outer peripheral surface of the rotor 2, an end face of the front side block 3 on the cam ring 1 side, and an end face of a control element 23 on the cam ring 1 side. The rotor 2 has its outer peripheral surface formed therein with a plurality of axial vane slits, not shown, at circumferentially equal intervals, in each of which a vane 13 is radially slidably fitted.

Refrigerant inlet ports 14, 14 are formed in the rear side block 4 at diametrically opposite locations, as shown in FIG. 1 (since FIG. 1 shows a cross-section taken at an angle of 90° formed about the longitudinal axis of the compressor, only one refrigerant inlet port is shown in the figure.) These refrigerant inlet ports 14 axially extend through the rear side block 4, and through which the suction chamber 11 and the compression spaces 12 are communicated with each other.

Refrigerant outlet ports 15, 15 each having two openings, are formed through opposite lateral side walls of the cam ring 1 at diametrically opposite locations (in FIG. 1, for the same reason as in the case of the refrigerant inlet ports, only one of the refrigerant outlet ports is shown). To each of the opposite lateral side walls of the cam ring 1 is secured by a bolt 17 a discharge valve cover 16 having a valve stopper 16*a*. Disposed between the lateral side wall and the valve stopper 16*a* is a discharge valve 18 which is retained on the discharge valve cover 16. Discharging spaces 19 which communicate with the respective refrigerant outlet ports 15 when the discharge valves 18 open are defined between the cam ring 1 and the respective discharge valve covers 16 at diametrically opposite locations. A pair of passages 20 are formed in the front side block 3 at diametrically opposite locations thereof, which each communicate with a corresponding one of the discharging spaces 19, whereby when each discharge valve 18 opens to thereby open the corresponding refrigerant outlet port 15, a compressed refrigerant gas in the compression space 12 is discharged from the discharge port 5*a* via the refrigerant outlet port 15, the discharging space 19, the passage 20, and the discharge pressure chamber 10, in the mentioned order.

As shown in FIGS. 1 and 3*a*, the rear side block 4 has an end face facing the rotor 2, in which is formed an annular recess 21. A pair of pressure working chambers 22, 22 are formed in a bottom of the annular recess 21 at diametrically opposite locations. A control element 23, which is in the form of an annulus, is received in the annular recess 21 for rotation about its own axis in opposite circumferential directions. The control element 23 controls the timing of start of compression of the compressor, and has its outer peripheral edge formed with a pair of diametrically opposite arcuate cut-out portions, not shown, and its one side surface formed integrally with a pair of diametrically opposite pressure-receiving protuberances 23*a*, 23*a* axially projected therefrom and acting as pressure-receiving elements. The pressure-receiving protuberances 23*a*, 23*a* (see FIG. 3*a*) are slidably received in respective pressure working chambers 22, 22. The interior of each pressure working chamber 22 is divided into a low-pressure chamber $22_1$ and a high-pressure chamber $22_2$ by the associated pressure-receiving protuberance 23*a*.

Each low-pressure chamber $22_1$ communicates with the suction chamber 11 through the corresponding refrigerant inlet port 14 to be supplied with the refrigerant gas under suction pressure Ps or low pressure.

As shown in FIGS. 1, 2, and 3*a*, one of the high-pressure chambers $22_2$ is connected to one of the discharging spaces 19 through a high pressure-introducing passageway 30 having a restriction hole 31, and at the same time the high-pressure chambers $22_2$ are connected with each other through a communication passageway 24. This arrangement makes it possible to introduce the refrigerant gas under discharge pressure Pd from the discharging space 19 into the high-pressure chambers $22_2$ by way of the restriction hole 31 to create control pressure Pc therein. An electromagnetic valve 40 is mounted in the rear side block 4 and the rear head 6 for opening and closing the restriction hole 31 in response to an external control signal supplied from a control unit 60 arranged at the outside of the compressor. Further, the one high-pressure chamber $22_2$ is connected to the suction chamber 11 through a leak passage 50 having a cross-sectional area smaller than that of the restriction hole 31 to thereby allow a very small amount of refrigerant gas to constantly leak from the one high-pressure chamber $22_2$ into the suction chamber 11.

Thus, the control element 23 is rotatively urged by the control pressure Pc within the high-pressure chambers $22_2$ toward the maximum capacity position, and on the other hand by the sum of the suction pressure Ps within the low-pressure chambers $22_1$ and the urging force of a coiled spring 25 toward the minimum capacity position, whereby the circumferential position of the control element 23 is controlled by the difference between the control pressure Pc and the sum of the suction pressure Ps and the urging force of the coiled spring to thereby control the timing of start of compression.

The electromagnetic valve 40 comprises, as shown in FIG. 2, a passage-forming member 41 having the aforementioned restriction hole 31 formed therein, a bobbin 43 having an exciting coil 42 wound therearound, a core 44 having an integral radial flange sandwiched between one end of the bobbin 43 and one end of the passage-forming member 41 and a stem portion thereof fitted in the bobbin 43, a plunger 45, formed of a magnetic material, which has an enlarged portion 45*a* slidably fitted in the bobbin 43 and a needle valve 45*b* formed integrally with the enlarged portion 45*a* and slidably fitted through a through bore 44*a* formed through the core 44, a stopper 46 disposed on the side of the the other end of the bobbin 43 for restricting the displacement of the plunger 45 in the rightward direction as viewed in FIG. 2, and a spring 47 urging the plunger 45 in the rightward direction, and a covering member 48 having one end thereof caulked to a radial flange 41*a* formed integrally on the passage-forming member 41 and the other end thereof caulked to one end of the stopper 46. Further, the stopper 46 holds a conductor 49 for supplying the exciting coil 42 with the external control signal from the control unit 60 shown in FIG. 1. The assembly of the electromagnetic valve 40 is mounted in a mounting hole 4*a* of the rear side block 4 and a mounting hole 6*a* of the rear head 6 such that the passage-forming member 41 and part of the covering member 48 are fitted in the mounting hole 4*a* and the rest of the covering member 48 is fitted in the mounting hole 6*a*, while an open end of the mounting hole 6*a* on the side of the stopper 46 is closed with a cover 48*a*.

An annular space 32 is defined between the outer peripheral surface of the passage-forming member 41 and the inner peripheral surface of the mounting hole 4*a*, and a space 33 between an open end face of the passage-forming member 41 and a bottom of the mounting hole 4*a*. The passage-forming member 41 has a central hole 41*b* axially formed therein, a communicating hole 41*c* communicating the central hole 41*b* with the annular space 32, and an enlarged hole 41*d* which opens into the space 33 and communicates with the central hole 41*b* by way of the restriction hole 31.

The annular space 32 is connected to the discharging space 19 via a passage 34 in the rear side block 4 and a passage 35 in the cam ring 1, while the space 33 is connected to one of the high-pressure chambers $22_2$ via a passage 36. Thus, the high pressure-introducing passageway 30 for communicating one of the high-pressure chambers $22_2$ with one of the discharging spaces 19 is formed of the passages 35, 34, annular space 32, communicating hole 41*c*, central hole 41*b*, restriction hole 31, enlarged hole 41*d*, space 33, and passage 36.

The control unit (C/U) 60 supplies the electromagnetic valve 40 with an ON/OFF signal (external control signal) for duty-ratio control of a time period over which the electromagnetic valve should be opened (or closed), based on input signals, such as a signal (rpm) indicative of the rotational speed of an engine driving the compressor, a signal (Tem) indicative of the temperature on the outlet side of an evaporator, not shown, representing thermal load on the compressor, and an acceleration signal for so-called acceleration cut generated when acceleration of the vehicle is detected.

Next, there will be described the operation of the thus-constructed variable capacity vane compressor.

The control unit 60 supplies the exciting coil 42 with the ON/OF signal as the external control signal, having a duty ratio, i.e. the ratio between the on time period and the off time period thereof determined by the aforementioned signals including the signal (rpm) indicative of the engine rotational speed. The exciting coil 42 and the core 44 do not generate a magnetically attractive force (valve-closing force) while the control signal has a low level, so that the plunger 45 is biased by the urging force of the spring 47 in a rightward or valve-opening position as shown in FIG. 2. On this occasion, a left end of the plunger 45 is disengaged from the surface of a valve seat formed by an open end of the restriction hole 31, to thereby open the restriction hole 31, i.e. the electromagnetic valve 40 is open. On the other hand, the exciting coil 42 and the core 44 generate a magnetically attractive force while the control signal has a high level, so that the plunger 45 is magnetically attracted against the urging force of the spring 47 in the leftward direction into a valve-closing position where the end of the plunger 45 becomes seated on the surface of the valve seat to thereby close the restriction hole 31, i.e. the electromagnetic valve 40 is closed.

When the electromagnetic valve 40 opens, i.e. the needle valve 45*b* opens the restriction hole 31 (as shown in FIGS. 2 and 3*a*) as described above, refrigerant gas under discharge pressure Pd is introduced from the discharging space 19 through the high pressure-introducing passage 30 including the restriction hole 31 into the high-pressure chambers $22_2$. On this occasion, a very small amount of refrigerant gas continues to leak into the suction chamber 11 via the leak passage 50. However, the flow rate of leaking refrigerant gas is small compared with the flow rate of refrigerant gas introduced into the high-pressure chambers $22_2$. Consequently, the control pressure Pc rises to cause the control element 23 to rotate toward the maximum capacity position, increasing the capacity or deliverly quantity of the compressor. When the control element 23 reaches the maximum capacity position as shown in FIG. 3*a*, the capacity or delivery quantity of the compressor becomes the maximum.

On the other hand, when the electromagnetic valve 40 is closed, i.e. the needle valve 45*b* closes the restriction hole 31 (as shown in FIG. 2*b*) as described above, refrigerant gas under discharge pressure Pd ceases to be introduced into the high-pressure chambers $22_2$. Since on this occasion a very small amount of refrigerant gas continues to leak into the suction chamber via the leak passage 50, the control pressure Pc falls to cause the control element 23 to rotate toward the minimum capacity position, decreasing the capacity or delivery quantity of the compressor. When the control element reaches the minimum capacity position as shown in FIG. 3*b*, the capacity or delivery quantity of the compressor becomes the minimum.

As noted above, the control pressure Pc within the high-pressure chambers $22_2$ rises during duration of the off time period and falls during duration of the on time period. That is, the control pressure Pc assumes a level corresponding to the ratio of the on time period to the off time period of the control signal, i.e. duty ratio of the control signal. Therefore, in the case where the thermal load increases to cause the temperature on the outlet side of the evaporator to rise, the control unit 60 outputs a control signal having a decreased ratio of the on time period to the off time period in response to the rise in the temperature. In contrast, in the case where the thermal load decreases to cause the temperature on the outlet side of the evaporator to fall, the control unit 60 outputs a control signal having an increased ratio of the on time period to the off time period in response to the fall in the temperature.

According to the above described embodiment, the restriction hole 31 having a small cross-sectional area is opened and closed by the electromagnetic valve 40 in response to the control signal supplied from the outside to thereby control the amount of the refrigerant gas under the discharge pressure Pd introduced into the high-pressure chambers $22_2$, while constantly allowing a very small amount of refrigerant gas to leak from one of the high-pressure chambers $22_2$ into the suction chamber 11, whereby the control pressure within the high-pressure chambers $22_2$ is varied. Therefore, load exerted on the electromagnetic valve 40 is small, which therefore requires a reduced valve-closing force. Thus, it is possible to employ an electromagnetic valve 40 capable of generating a small valve-closing force, and hence the control pressure Pc, i.e. the capacity or delivery quantity of the compressor can be accurately controlled from the outside in a fine manner. Further, the control pressure Pc is not fluctuated largely, which results in reduced vibration and reduced noise produced thereby.

Next, explanation will be made as to the magnitude of the valve-closing force required of the electromagnetic valve 40 in the above embodiment.

In the following explanation, $s_1$ and $s_2$ represent the cross-sectional areas of respective restriction hole 31 and leak passage 50.

(i) To vary the control pressure Pc within a range of approx. 2 to 14 kg/cm$^2$ to continuously control the capacity or delivery quantity of the compressor between the minimum and the maximum, the control pressure Pc is required to assume a level of e.g. $Pc \geqq Pd - 0.2$ kg/cm$^2$ when the capacity or delivery quantity of the compressor is the maximum ($Pd \fallingdotseq 14$ kg/cm$^2$) with the electromagnetic valve 40 being open at the maximum duty ratio. When the control pressure Pc has reached a constant level while the capacity of the compressor is the maximum, the flow rate $Q_1$ of refrigerating gas flowing through the restriction hole 31 and the flow rate $Q_2$ of refrigerant gas leaking through the leak passage 50 are equal to each other. Therefore, $$Q_1 = Q_2 \approx \alpha s_1 \sqrt{(Pd - Pc)/\rho} \fallingdotseq \alpha s_2 \sqrt{(Pd - Ps)/\rho}$$

where $\alpha$ represents a flow coefficient and $\rho$ the density of refrigerant gas.

From this, the following equation (1) can be obtained:

$$s_1/s_2 = \sqrt{(Pc - Ps)/(Pd - Pc)} \quad (1)$$

Since the control pressure Pc is required to assume a level of $Pc \geqq Pd - 0.2$ (kg/cm$^2$) as mentioned above, $Pd - 0.2$ is substituted for Pc in the equation (1). Then the following equation (1') is obtained:

$$s_1/s_2 = \sqrt{(Pd - 0.2 - Ps)/0.2} \quad (1')$$

Assuming that normally $Pd = 14$ kg/cm$^2$ and $Ps \fallingdotseq 2$ kg/cm$^2$, the equation (1') can be transformed into the following equation:

$$s_1/s_2 = \sqrt{11.8/0.2} \fallingdotseq 7.7$$

(ii) In the meanwhile, an amount of refrigerant gas which can be allowed to leak through the leak passage 50 is empirically known. The value of the amount is equivalent to the cross-sectional area $s_2$ of the leak passage, which should be $\leqq$ approx. 0.08 mm$^2$.

$$\text{Therefore, } s_1 = 7.7 s_2 = 0.616 \text{ mm}^2 \quad (ii)$$

(iii) Next, there will be considered load exerted on the electromagnetic valve 40 when it is opened.

It is necessary to design the electromagnetic valve 40 so as to withstand a differential pressure of $Pd - Pc \geqq$ approx. 28 kg/cm$^2$ exerted thereon at the maximum. Therefore, from the equation (ii), the maximum value of the load is calculated as follows:

$$28 \text{ kg/cm}^2 \times 0.00616 \text{ cm}^2 = 0.173 \text{ kg}$$

Therefore, a force as small as approx. 500 g is sufficient as the valve-closing force to be exerted by the electromagnetic valve 40.

FIG. 4 shows a variation of the above described embodiment of the invention.

In this variation, the space 33 is connected to one of the discharging spaces 19 via a passage 34' in the rear side block 4 and a passage 35' in the cam ring 1, while the annular space 32 is connected to one of the high-pressure chambers $22_2$ via a passage 36' in the rear side block.

With this arrangement according to this variation, when the electromagnetic valve 40 opens to open the restriction hole 31, refrigerant gas under discharge pressure Pd is introduced from the discharging space 19 into the high-pressure chambers $22_2$ through the high pressure-introducing passage 30 in the order of the passages 35' and 34', space 33, enlarged hole **41*d*, restriction hole 31, central hole 41*b*, communicating hole 41*c*, annular space 32, and passage 36'**.

Also this variation provides equivalent results to those of the aforedescribed embodiment.

What is claimed is:

1. In a variable capacity vane compressor being controllable by an external control signal, including a suction chamber, a discharging space within which discharge pressure prevails, a control element for determining timing of start of compression of a refrigerant gas, said control element having a pressure-receiving portion, a low-pressure chamber within which prevails suction pressure acting on said pressure-receiving portion of said control element, urging means cooperating with said suction pressure for urging said control element toward a minimum capacity position thereof, a high-pressure chamber within which prevails control pressure acting on said pressure-receiving portion of said control element for urging said control element toward a maximum capacity position thereof, and high pressure-introducing passage means for introducing said refrigerant gas from said discharging space into said high-pressure chamber to create said control pressure therein, said high pressure-introducing passage means having a restriction hole for restricting flow of said refrigerant gas, the improvement comprising:

an electromagnetic valve diposed to open and close said restriction hole in response to said external control signal; and leak passage means for allowing said refrigerant gas to constantly leak from said high-pressure chamber into said suction chamber, said leak passage means having a cross-sectional area smaller than that of said restriction hole.

2. A variable capacity vane compressor according to claim 1, wherein the cross-sectional area of said restriction hole is approximately 7.7 times as large as that of said leak passage.

3. A variable capacity vane compressor according to claim 1, wherein said opening and closing of said restriction hole by said electromagnetic valve is controlled by varying a duty ratio of said external control signal.

4. A variable capacity vane compressor according to claim 1, including a side block having a recessed portion, and a passage-forming member fitted in said recessed portion and having a first passage formed therein, said restriction hole being part of said first passage, and wherein said high pressure-introducing passage means comprises a second passage formed in said side block for introducing thereinto said refrigerant gas from said discharging space, an annular passage defined between an inner peripheral surface of said recessed portion of said side block and an outer peripheral surface of said passage-forming member and communicating with said second passage, said first passage having an end thereof communicating with said annular passage, a second space defined between a bottom of said recessed portion and an end face of said passage-forming member and communicating with another end of said first passage, and a third passage formed in said side block and communicating with said second space and said high-pressure chamber for introducing said refrigerant gas from the former to the latter.

5. A variable capacity vane compressor according to claim 1, including a side block having a recessed portion, and a passage-forming member fitted in said recessed portion and having a first passage formed therein, said restriction hole being part of said first passage, and wherein said high pressure-introducing passage means comprises a second passage formed in said side block for introducing thereinto said refrigerant gas from said discharging space, a second space defined between a bottom of said recessed portion and an end face of said passage-forming member and communicating with said second passage, said first passage having an end thereof communicating with said second space, an annular passage defined between an inner peripheral surface of said recessed portion of said side block and an outer peripheral surface of said passage-forming member and communicating with another end of said first passage, and a third passage formed in said side block and communicating with said annular space and said high-pressure chamber for introducing said refrigerant gas from the former to the latter.

6. A variable capacity vane compressor according to claim 3, including a side block having a recessed portion, and a passage-forming member fitted in said recessed portion and having a first passage formed therein, said restriction hole being part of said first passage, and wherein said high pressure-introducing passage means comprises a second passage formed in said side block for introducing thereinto said refrigerant gas from said discharging space, an annular passage defined between an inner peripheral surface of said recessed portion of said side block and an outer peripheral surface of said passage-forming member and communicating with said second passage, said first passage having an end thereof communicating with said annular passage, a second space defined between a bottom of said recessed portion and an end face of said passage-forming member and communicating with another end of said first passage, and a third passage formed in said side block and communicating with said second space and said high-pressure chamber for introducing said refrigerant gas from the former to the latter.

7. A variable capacity vane compressor according to claim 3, including a side block having a recessed portion, and a passage-forming member fitted in said recessed portion and having a first passage formed therein, said restriction hole being part of said first passage, and wherein said high pressure-introducing passage means comprises a second passage formed in said side block for introducing thereinto said refrigerant gas from said discharging space, a second space defined between a bottom of said recessed portion and an end face of said passage-forming member and communicating with said second passage, said first passage having an end thereof communicating with said second space, an annular passage defined between an inner peripheral surface of said recessed portion of said side block and an outer peripheral surface of said passage-forming member and communicating with another end of said first passage, and a third passage formed in said side block and communicating with said annular space and said high-pressure chamber for introducing said refrigerant gas from the former to the latter.

* * * * *